United States Patent [19]

Hasegawa

[11] Patent Number: 4,493,300

[45] Date of Patent: Jan. 15, 1985

[54] METHOD OF CONTROLLING THE FUEL SUPPLY TO AN INTERNAL COMBUSTION ENGINE AT DECELERATION

[75] Inventor: Shumpei Hasegawa, Niiza, Japan

[73] Assignee: Honda Motor Co., Ltd., Tokyo, Japan

[21] Appl. No.: 590,202

[22] Filed: Mar. 16, 1984

[30] Foreign Application Priority Data

Apr. 8, 1983 [JP] Japan ..... 58-61864

[51] Int. Cl.[3] ..... F02D 5/02

[52] U.S. Cl. ..... 123/325; 123/493

[58] Field of Search ..... 123/493, 494, 492, 325, 123/326

[56] References Cited

U.S. PATENT DOCUMENTS 3,931,808 1/1976 Rachel ..... 123/488
4,050,878 9/1977 Priegel ..... 123/488 X
4,143,622 3/1979 Klotzner et al. ..... 123/487 X
4,284,053 8/1981 Merrick ..... 123/493 X
4,393,842 7/1983 Otsuka et al. ..... 123/440

*Primary Examiner*—Tony M. Argenbright
*Attorney, Agent, or Firm*—Arthur L. Lessler

[57] ABSTRACT

A method of controlling the fuel supply to an internal combustion engine at deceleration thereof, wherein the fuel supply to the engine is interrupted when the engine is operating in a predetermined operating region in which is satisfied at least a condition that the intake passage pressure is lower than a predetermined value, while the engine is decelerating. The predetermined value of intake passage pressure is corrected in a manner responsive to a detected value of atmospheric pressure encompassing the engine. Preferably, the intake passage pressure is detected in terms of absolute pressure at a zone downstream of a throttle valve arranged therein, and the above predetermined value of intake passage pressure is corrected to smaller values as the detected value of the atmospheric pressure decreases.

3 Claims, 6 Drawing Figures

METHOD OF CONTROLLING THE FUEL SUPPLY TO AN INTERNAL COMBUSTION ENGINE AT DECELERATION

BACKGROUND OF THE INVENTION

This invention relates to a fuel supply control method for an internal combustion engine at deceleration, and more particularly to a method of this kind which is adapted to vary the range of an operating region of the engine wherein the fuel supply to the engine is interrupted, in response to the atmospheric pressure.

When supply of fuel to the engine is carried out while the intake pipe absolute pressure is low at deceleration of the engine with the throttle valve fully closed, a large quantity of unburnt fuel is emitted together with the exhaust gases, badly affecting the fuel consumption, emission characteristics, etc. of the engine. Also, in an internal combustion engine having a device for purifying the exhaust gases, like a three-way catalyst, a large quantity of unburnt fuel emitted together with the exhaust gases can cause burning of the bed of such exhaust gas purifying device, thereby increasing the emission of detrimental exhaust gases. A method for preventing the inconveniences such as described above is widely known, which carries out interruption of the fuel supply to the engine, i.e. fuel cut, while the engine is operating in a predetermined operating region at deceleration.

According to this known method, if the determination as to whether or not the engine is operating in the above predetermined operating region is made on the basis of the throttle valve opening when the engine speed is high, it can happen that fuel cut is not carried out even when the intake pipe absolute pressure is low enough for fuel cut to be carried out, resulting in the above-mentioned inconveniences. Therefore, it has previously been proposed by the assignee of the present application in Japanese Provisional Patent Publication (Kokai) No. 57(1982)-191426 that when the engine speed is high, the above predetermined operating region be determined on the basis of the intake pipe absolute pressure as well as the engine speed. More specifically, the predetermined operating region is set such that fuel cut is effected depending upon the engine speed even when the throttle valve is not fully closed, so long as the intake pipe absolute pressure is lower than an absolute pressure line assumed with no load on the engine but higher than another absolute pressure line corresponding to the maximum allowable bed temperature of the three-way catalyst below which the temperature of the three-way catalyst rises to an abnormal extent.

However, even if the above predetermined operating region of the engine is determined solely on the basis of the engine speed as well as the intake pipe absolute pressure, as proposed by the above method, without taking account of variations in atmospheric pressure encompassing the engine, the phenomenon can occur that the above-mentioned absolute pressure line assumed at no engine load is moved toward a lower absolute pressure side as the ambient atmospheric pressure decreases, when the engine is operated in a low atmospheric pressure condition, such as at a high altitude, thus reducing the range of the predetermined operating region, i.e. the fuel cut effecting region, of the engine. That is, while the engine is operated in a low atmospheric pressure condition with no engine load applied thereon, the detected intake pipe absolute pressure can assume a value lower than the absolute pressure value for determining whether or not fuel cut should be carried out. On such an occasion, if the accelerator pedal of the engine is stepped on to increase the engine speed while the engine is at idle, fuel cut can be carried out in the course of an increase of the engine speed, causing hunting of the engine rotation and other inconveniences. Although these inconveniences may be overcome by setting the fuel cut determining value of absolute pressure at a lower value for stable operation of the engine in a low atmospheric pressure condition, the range of the fuel cut effecting region is undesirably reduced, thereby hindering improvements in the fuel consumption, emission characteristics, etc. of the engine.

SUMMARY OF THE INVENTION

It is the object of the invention to provide a fuel supply control method for an internal combustion engine at deceleration, which is adapted to determine the fuel cut effecting region with accuracy in response to atmospheric pressure encompassing the engine, to thereby ensure desired driveability of the engine as well as to improve the fuel consumption, emission characteristics, etc. of the engine.

The invention provides a method of controlling the fuel supply to an internal combustion engine having an intake passage, at deceleration of the engine, wherein the fuel supply to the engine is interrupted when the engine is operating in a predetermined operating region in which is satisfied at least a condition that the intake passage pressure is lower than a predetermined value, while the engine is decelerating. The method of the invention is characterized by comprising the steps of: (a) detecting a value of atmospheric pressure encompassing the engine; and (b) correcting the predetermined value of intake passage pressure in response to the above detected value of the atmospheric pressure. Preferably, the intake passage pressure is detected in terms of absolute pressure at a zone downstream of a throttle valve arranged therein. Also preferably, the above predetermined value of intake passage pressure is corrected to smaller values as the detected value of the atmospheric pressure decreases.

The above and other objects, features and advantages of the invention will be more apparent from the ensuing detailed description taken in conjunction with the accompanying drawings.

DETAILED DESCRIPTION

The present invention will now be described in detail with reference to the drawings.

Figure 1:
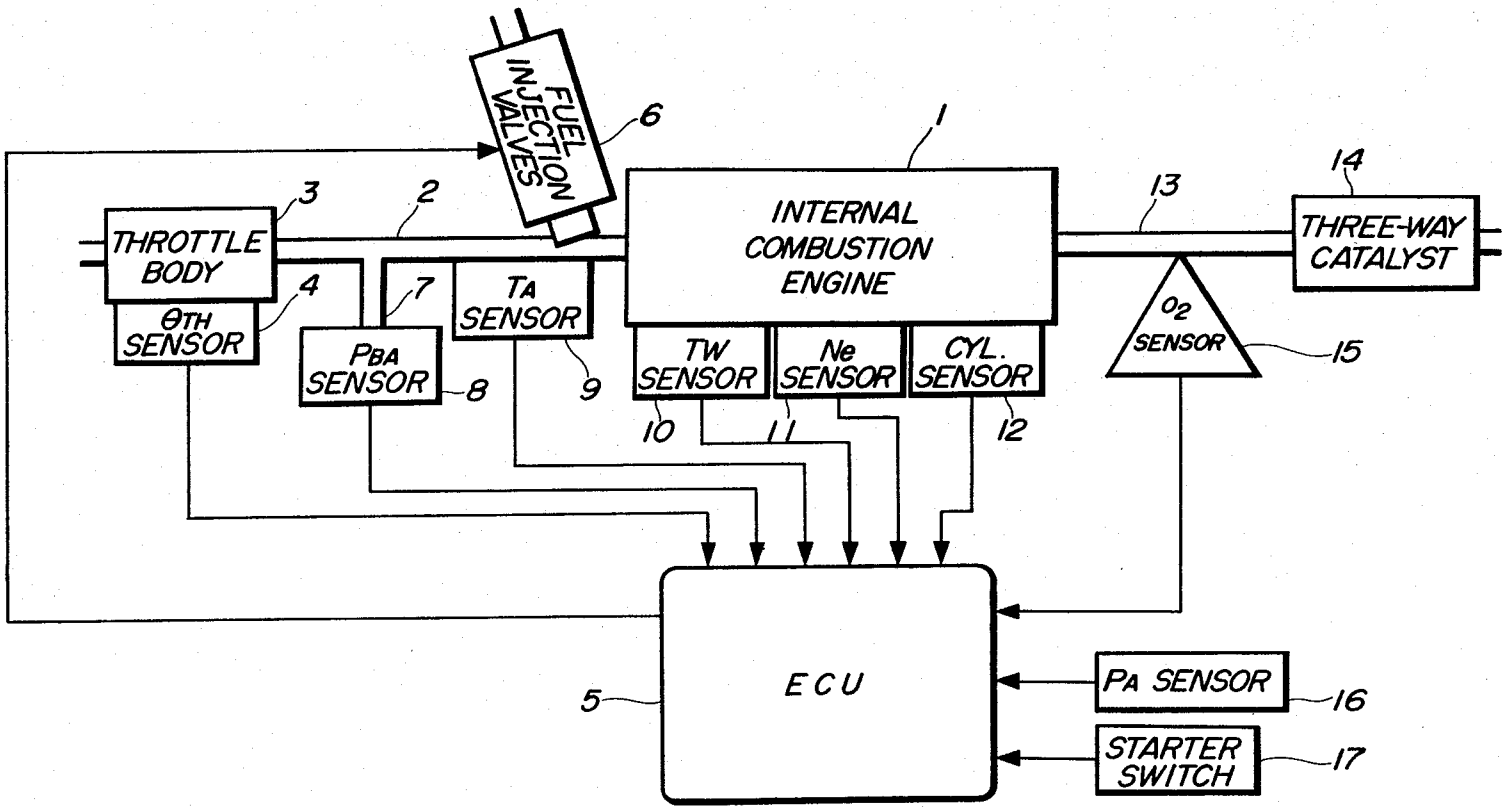
FIG. 1 is a block diagram illustrating the whole arrangement of a fuel supply control system to which is applicable the method according to the present invention.

Referring first to FIG. 1, there is schematically illustrated an example of the whole arrangement of a fuel supply control system for internal combustion engines, to which the present invention is applicable. Reference numeral 1 designates an internal combustion engine which may be a four-cylinder type, for instance, and to which is connected an intake passage 2 with a throttle body 3 arranged therein. A throttle valve opening ($\theta$TH) sensor 4 is connected to a throttle valve in the throttle body 3 for detecting its valve opening and is electrically connected to an electronic control unit (hereinafter called "the ECU") 5, to supply same with an electrical signal indicative of throttle valve opening detected thereby.

Fuel injection valves 6 are each arranged in the intake passage 2 at a location slightly upstream of an intake valve of a corresponding one of the engine cylinders, not shown, and between the engine 1 and the throttle valve, for fuel supply to the corresponding engine cylinder. Each of such fuel injection valves 6 is connected to a fuel pump, not shown, and is electrically connected to the ECU 5, in a manner having their valve opening periods or fuel injection quantities controlled by signals supplied from the ECU 5.

On the other hand, an absolute pressure (PBA) sensor 8 communicates through a conduit 7 with the interior of the intake passage 2 at a location immediately downstream of the throttle valve. The absolute pressure sensor 8 is adapted to detect absolute pressure in the intake passage 2 and applies an electrical signal indicative of detected absolute pressure to the ECU 5. An intake air temperature (TA) sensor 9 is arranged in the intake passage 2 at a location downstream of the absolute pressure sensor 8 and also electrically connected to the ECU 5 for supplying same with an electrical signal indicative of detected intake air temperature.

An engine cooling water temperature (TW) sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm (Ne) sensor 11 and a cylinder-discriminating (CYL) sensor 12 are arranged on a camshaft, not shown, of the engine 1 or a crankshaft of same, not shown. The former 11 is adapted to generate one pulse at a particular crank angle each time the engine crankshaft rotates through 180 degrees, i.e., upon generation of each pulse of the top-dead-center position (TDC) signal, while the latter 12 is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are an atmospheric pressure (PA) sensor 16 for detecting atmospheric pressure and a starter switch 17 for actuating the starter of the engine 1, respectively, for supplying an electrical signal indicative of detected atmospheric pressure and an electrical signal indicative of its own on and off positions to the ECU 5.

The ECU 5 operates on the basis of the various engine parameter signals inputted thereto to determine engine operating conditions including the fuel cut effecting conditions as well as to calculate the valve opening period TOUT of the fuel injection valves 6 in response to the determined engine operating conditions by means of the following equation:

$$TOUT = Ti \times K_1 + K_2 \quad (1)$$

wherein Ti represents a basic value of the fuel injection period and is calculated as a function of the intake passage absolute pressure PBA and the engine speed Ne, and $K_1$ and $K_2$ represent correction coefficients or correction variables having their values dependent upon the values of signals from the aforementioned various sensors, that is, the throttle valve opening ($\theta$TH) sensor 4, the intake passage absolute pressure (PBA) sensor 8, the intake air temperature (TA) sensor 9, the engine cooling water temperature (TW) sensor 10, the Ne sensor 11, the cylinder-discriminating (CYL) sensor 12, the $O_2$ sensor 15, the atmospheric pressure (PA) sensor 16, and the starter switch 17, and are calculated by the use of predetermined equations, so as to optimize the startability, emission characteristics, fuel consumption, accelerability, etc. of the engine.

Figure 2:
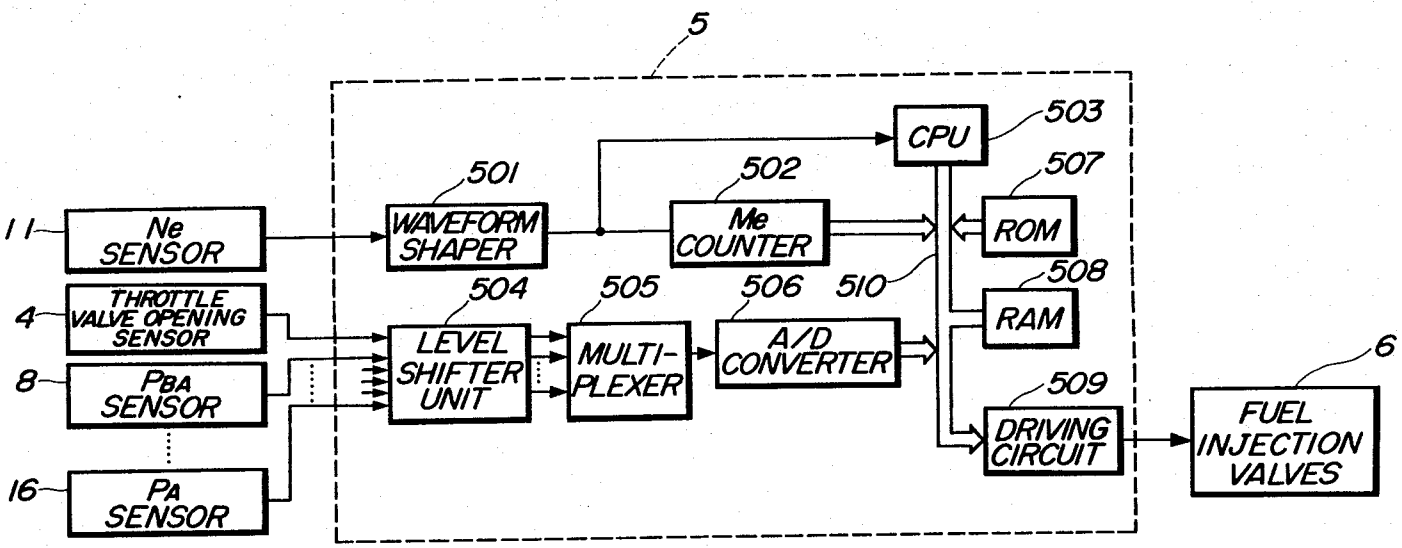
FIG. 2 is a circuit diagram showing an electrical circuit within the electronic control unit (ECU) in FIG. 1.

The ECU 5 supplies driving signals to the fuel injection valves 6 to open same with a duty factor corresponding to the valve opening period TOUT calculated in the above manner FIG. 2 shows an electrical circuit within the ECU 5 in FIG. 1. The engine rpm signal from the NE sensor 11 in FIG. 1 is applied to a waveform shaper 501, wherein it has its waveform shaped, and supplied to a central processing unit (hereinafter called "the CPU") 503 as a TDC signal as well as to a ME counter 502. The Me counter 502 counts the interval of time between a preceding pulse of the engine rpm signal from the Ne sensor 11 and a present pulse of the same signal, and accordingly its counted value Me is proportional to the reciprocal of the actual engine rpm Ne. The Me counter 502 supplies the counted value Me to the CPU 503 via a data bus 510.

The respective output signals from the throttle valve opening ($\theta$TH) sensor 4, the intake passage absolute pressure (PBA) sensor 8, the atmospheric pressure (PA) sensor 16, all appearing in FIG. 1, and other sensors, if any, have their voltage levels shifted to a predetermined voltage level by a level shifter unit 504 and successively applied to analog-to-digital converter 506 through a multiplexer 505. The A/D converter 506 successively converts the above signals into digital signals and supplies them to the CPU 503 via the data bus 510.

The CPU 503 is also connected to a read-only memory (hereinafter called "the ROM") 507, a random access memory (hereinafter called "the RAM") 508, and a driving circuit 509, through the data bus 510. The RAM 508 temporarily stores the resultant values of various calculations from the CPU 503, while the ROM 507 stores a control program executed within the CPU 503, a look-up table for basic values of fuel injection period of fuel injection valves 6 predetermined fuel cut determining values corresponding to the atmospheric pressure PA, referred to later, etc. The CPU 503 executes the control program stored in the ROM 507 to calculate the valve opening period TOUT for the fuel injection valves 6 in response to the various engine parameter signals referred to before, and supplies the calculated TOUT value to the driving circuit 509 via the data bus 510. The driving circuit 509 supplies driving signals corresponding to the above TOUT value to the fuel injection valves 6 to open same.

Figure 3:
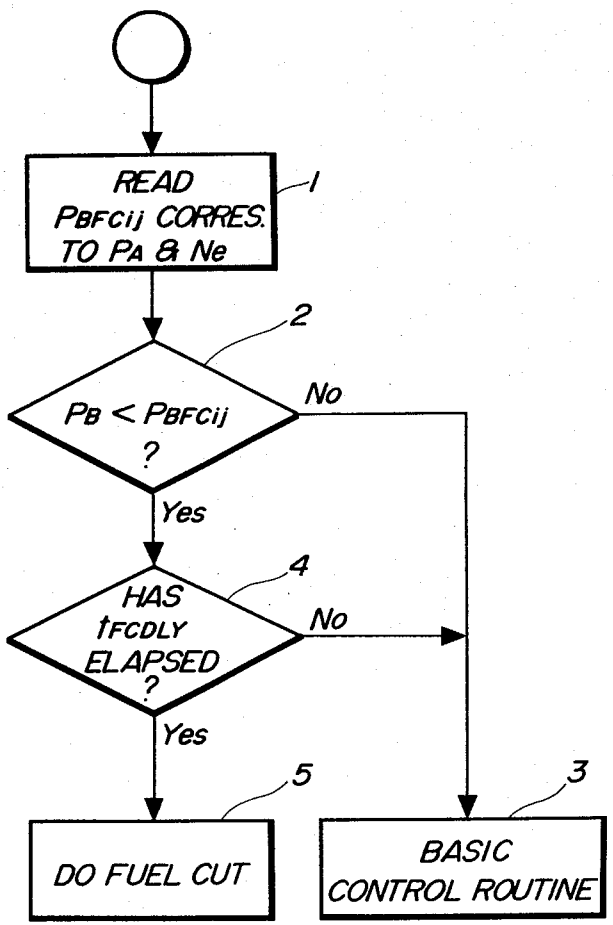
FIG. 3 is a flow chart showing a manner of determining the fuel cut effecting region of the engine according to the method of the invention.

FIG. 3 is a flow chart of a routine of the control program executed within the CPU 503 in FIG. 2 to determine whether or not the engine is operating in a predetermined fuel cut effecting region.

Figure 4:
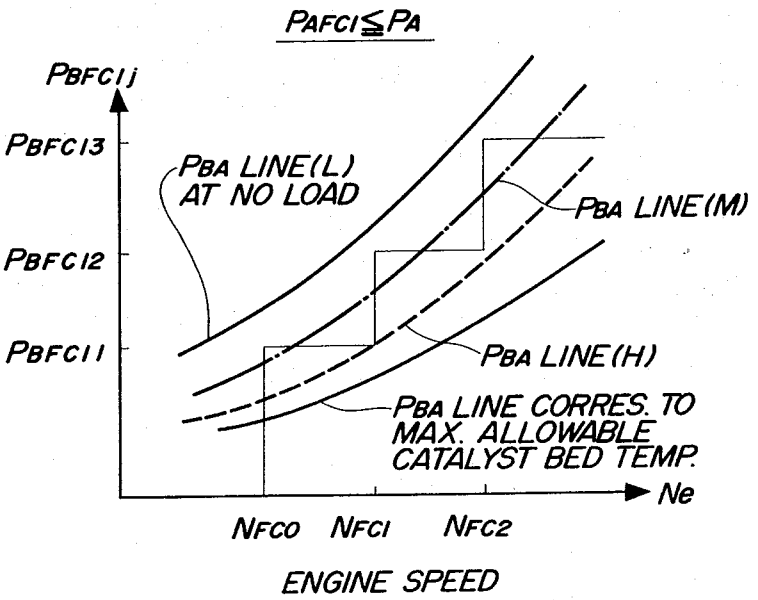
FIGS. 4 is a graph showing a table of the relationship between engine speed Ne and fuel cut determining absolute pressure PBFCij, which is applied when the atmospheric pressure PA assumes a value higher than or equal to a predetermined value PAFC1.
Figure 5:
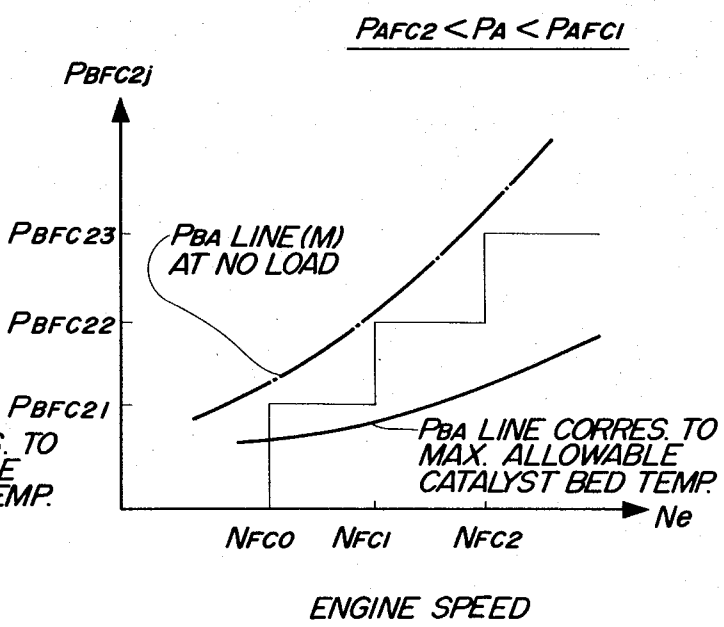
FIG. 5 is a graph similar to FIG. 4, which is applied when the atmospheric pressure PA assumes a value lower than the predetermined value PAFC1 and higher than a predetermined value PAFC2.
Figure 6:
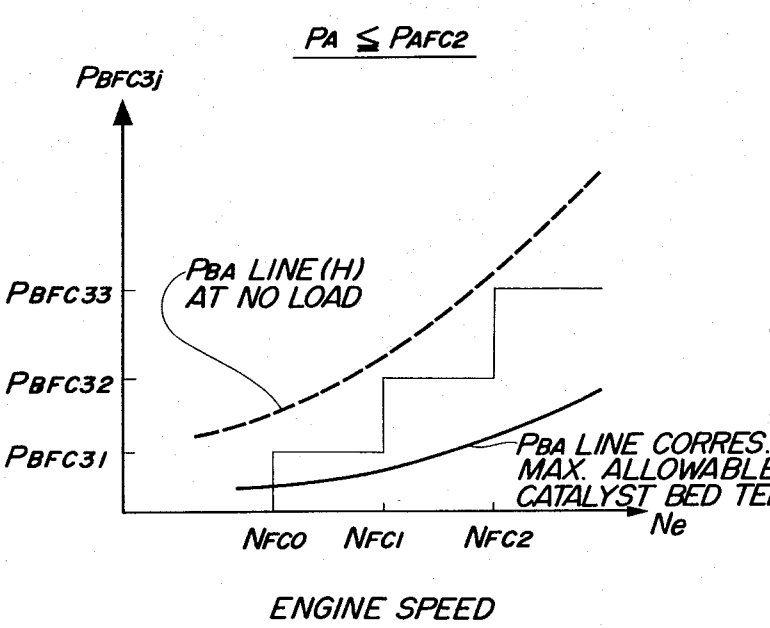
FIG. 6 is a graph similar to FIG. 4, which is applied when the atmospheric pressure PA assumes a value lower than the predetermined value PAFC2.

First, the CPU 503 reads a fuel cut determining absolute pressure value PBFCij corresponding to values of the engine rpm signal and the atmospheric pressure PA signal supplied thereto from the NE sensor 11 and the atmospheric pressure sensor 16, respectively, from one of PBFCij tables stored in the ROM 507, at the step 1. The PBFCij tables comprise three tables for instance, as shown in FIGS. 4, 5 and 6, which are selected depending on the detected value of ambient atmospheric pressure PA, and are each provided with three previously set values of engine rpm, i.e. NFC0 (1950 rpm), NFC1(2950 rpm), and NFC2 (3950 rpm). When the detected value of the atmospheric pressure PA is larger than or equal to a first predetermined value PAFC1 (680 mm Hg), the PBFCij table shown in FIG. 4 is applied to determine the fuel cut effecting region of the engine, in which are provided three fuel cut determining intake passage absolute pressure values PBFC11 (208 mm Hg), PBFC12 (228 mm Hg), and PBFC13 (248 mm Hg) corresponding to the above values NFC0, NFC1, and NFC2 of engine rpm, respectively. When the detected value of the atmospheric pressure PA is smaller than the first predetermined value PAFC1 and at the same time larger than a second predetermined value PAFC2 (580 mm Hg), the PBFCij table shown in FIG. 5 is selected for determining the fuel cut effecting region, while the PBFCij table shown in FIG. 6 is selected when the relationship PA≦PAFC2 stands. In each of the PBFCij tables of FIGS. 4, 5 and 6, the fuel cut determining intake passage absolute pressure value PBFCij is so set as to be smaller than an absolute pressure line which is assumed when the engine is operated with no load applied thereon in the corresponding atmospheric pressure condition, and at the same time larger than another absolute pressure line corresponding to the maximum allowable bed temperature of the three-way catalyst below which the temperature of the three-way catalyst rises to an abnormal extent. For the aid of explanation, the absolute pressure lines assumed with no engine load in the respective atmospheric pressure conditions in FIGS. 5 and 6 are also indicated in the FIG. 4 table by the one-dot chain line and the broken line, respectively. It will be clear from the three absolute pressure lines (L), (M) and (N) in FIG. 4 that the absolute pressure line assumed with no load on the engine is moved toward a lower absolute pressure side as the atmospheric pressure PA decreases so long as the rotational speed of the engine remains the same, and therefore, according to the invention, so long as the rotational speed of the engine remains the same, the fuel cut determining value PBFCij of intake passage absolute pressure is set to lower values as the atmospheric pressure PA decreases.

Reverting to FIG. 3, after reading the fuel cut determining value PBFCij in the above manner at the step 1, the present program executes the step 2 to determine whether or not a value of the intake passage absolute pressure PBA signal is smaller than the fuel cut determining value PBFCij obtained at the step 1. If the answer is no, the program proceeds to a basic control routine of the control program wherein a calculation is made of the valve opening period TOUT for the fuel injection valves 6 by the use of the aforementioned equation (1), at the step 3. On the other hand, if the answer to the question of the step 2 is yes, that is, if the engine is determined to be operating in the predetermined fuel cut effecting region, it is determined at the step 4 whether or not a predetermined period of time tFCDLY (e.g. 2 seconds) has elapsed after the engine entered the predetermined fuel cut effecting region for the first time. This determination is provided for preventing the phenomenon that fuel cut is wrongly carried out due to an erroneous signal inputted to the CPU 503, such as noise. When the predetermined period of time tFCDLY has not yet elapsed, that is, if the answer to the question of the step 4 is no, the program proceeds to the aforementioned step 3, while if the answer is yes, that is, when the predetermined period of time tFCDLY has elapsed, the program proceeds to the step 5 to carry out fuel cut.

The fuel cut determining values NFCi and PBFCij of the engine speed Ne and the intake passage absolute pressure PBA may each be set to different values between fuel cut initiation and fuel cut termination, to provide a hysteresis characteristic for the determination of the fuel cut effecting region, to thereby absorb slight fluctuations in the engine speed Ne and the absolute pressure PBA for stable operation of the engine.

Further, if required, the number of NFCi values of engine rpm and/or the number of PBFCij values of absolute pressure may be increased or decreased in the PBFCij tables of FIGS. 4–6. Also, the number of PBFCij tables per se may be increased or decreased by dividing the range of atmospheric pressure PAFC values in a different manner from the above example.

What is claimed is:

1. A method of controlling the fuel supply to an internal combustion engine having an intake passage, at deceleration of said engine, said method being adapted to interrupt the fuel supply to said engine when said engine is operating in a predetermined operating region in which is satisfied at least a condition that pressure in said intake passage is lower than a predetermined value, while said engine is decelerating, said method comprising the step of: (a) detecting a value of atmospheric pressure encompassing said engine; and (b) correcting said predetermined value of intake passage pressure in response to the detected value of said atmospheric pressure.

2. A method as claimed in claim 1, wherein said engine comprises a throttle valve arranged in said intake passage, said intake passage pressure being detected in terms of absolute pressure at a zone downstream of said throttle valve.

3. A method as claimed in claim 2, wherein said predetermined value of intake passage pressure is corrected to smaller values as the detected value of said atmospheric pressure decreases.

* * * * *